US005487198A

United States Patent [19]

Mueller et al.

[11] Patent Number: 5,487,198

[45] Date of Patent: Jan. 30, 1996

[54] TWO-PIECE HIGH TOP SHOE TREE

[75] Inventors: Roger P. Mueller, Jamesville; Roy P. Mueller, Baldwinsville, both of N.Y.; Joe Nemeth, Chomedey; Robert Schoning, Montreal, both of Canada

[73] Assignee: RPM Industries, Inc., Auburn, N.Y.

[21] Appl. No.: 296,651

[22] Filed: Aug. 26, 1994

[51] Int. Cl.[6] ..... A43D 5/00

[52] U.S. Cl. ..... 12/117.4; 12/115.6

[58] Field of Search ..... 12/128 R, 114.2, 12/115.6, 115.8, 116.2, 116.6, 117.4, 116.4; 36/42, 36 A, 36 B, 36 C, 42

[56] References Cited

U.S. PATENT DOCUMENTS

| | | | |
|---|---|---|---|
| 87,590 | 3/1869 | Pool | 12/115.6 |
| 2,582,551 | 1/1952 | Malherbe | 36/42 |
| 4,261,071 | 4/1981 | Forte | 12/115.6 |

FOREIGN PATENT DOCUMENTS

| | | | |
|---|---|---|---|
| 1296936 | 5/1962 | France | 12/128 R |
| 0008139 | of 1911 | United Kingdom | 36/42 |

*Primary Examiner*—Paul T. Sewell
*Assistant Examiner*—Ted Kavanaugh
*Attorney, Agent, or Firm*—Harris Beach & Wilcox

[57] ABSTRACT

A two-piece, high top shoe tree includes a toe member that has a distal tip end and a proximal end. The toe member is insertable into a toe portion of a respective shoe and formed to support the toe portion of the shoe. The shoe tree also includes a heel member that is insertable into a heel portion of the respective shoe and formed to support the heel portion thereof. The heel member has a forward end and a top end. The shoe tree is further provided with a quick release mechanism for securing the toe member to the heel member so that the toe member and the heel member may be assembled together and inserted into the respective shoe to give support thereto.

16 Claims, 4 Drawing Sheets

TWO-PIECE HIGH TOP SHOE TREE

BACKGROUND OF THE INVENTION

1. Field of the Invention

This invention relates in general to shoe trees and, in particular, to a high top shoe tree. More specifically, but without restriction to the particular embodiment hereinafter described in accordance with the best mode of practice, this invention relates to a flexible and detachable two-piece high top shoe tree.

2. Discussion of the Related Art

The retail shoe industry has typically employed a wide variety of shelving units and shoe racks to display articles offered for sale. These different shoe display devices are traditionally used by retail managers to organize the retailing space in a manner that optimizes product appeal, selection, and salability of the displayed shoes. The display devices are generally grouped organized to create a unique look and ambiance for the shoe department or within a particular shoe store.

Traditionally, shoe trees were employed as devices to give support and preserve the shape of hard leather shoes or boots. These traditional devices were either made from metal, wood, or a combination of these materials. Wood shoe trees also include a variety made of cedar, which has the added function of absorbing moisture from leather shoes. A variety of metal shoe trees are employed by cobblers as devices for stretching leather shoes or boots to a larger size. Prior hereto, shoe trees were not widely considered as both support and display devices.

Recently, high top canvas sneakers or basketball shoes and sports sandals have increased dramatically in popularity. The effective and appealing display of this type of footwear, in what has become a very competitive market including several manufactures and virtually hundreds of different styles, has become a means for distinguishing the goods and attracting purchasers. Such shoes typically have not been either stored or displayed with the use of shoe trees.

OBJECTS AND SUMMARY OF THE INVENTION

It is, therefore, an object of the present invention to improve shoe trees.

Another object of this invention is to utilize shoe trees in the display of shoes to increase the attractiveness of the displayed shoe.

It is a further object of the present invention to utilize shoe trees in the display of high top canvas or leather shoes to increase the attractiveness and appealability of the displayed shoe.

Still another object of the present invention is to employ a high top shoe tree to display shoes and sandals so that the shoe or sandal contains a facsimile of a human foot including the ankle portion.

It is still a further object of the present invention to utilize a high top shoe tree to support and preserve the form of a high top shoe during storage and display of the shoe by a retailer or nonuse of the shoe by a purchaser of the shoe.

Yet another object of the present invention is to form a two-piece high top shoe tree having a toe member and a heel member.

An additional object of the present invention is to quickly attach and detach the toe member and the heel member of a two-piece high top shoe tree.

Still a further object of the present invention is to separately utilize the toe member of a two-piece high top shoe tree to support the toe portion of a shoe, boot, or sandal.

It is yet a further object of the present invention to separately utilize the heel member of a two-piece high top shoe tree to support the heel portion of a shoe, boot, or sandal.

Yet still another object of the present invention is to use a light-weight plastic material to mold the toe member and the heel member of a two-piece high top shoe tree.

Another additional object of the present invention is to form a flexible mid-section between the toe member and the heel member of a two-piece high top shoe tree so that the two members of the shoe tree are movable relative to each other.

These and other objects are attained in accordance with the present invention wherein there is provided a two-piece, high top shoe tree. According to one aspect of this invention, the present shoe tree includes a toe member that has a distal tip end and a proximal end. The toe member is insertable into a toe portion of a respective shoe and formed to support the toe portion of the shoe. In accordance with another aspect of the present invention, the shoe tree also includes a heel member that is insertable into a heel portion of the respective shoe and formed to support the heel portion thereof. The heel member has a forward end and a top end. In one embodiment of the present invention, the heel member is substantially L-shaped in form. According to yet another aspect of this invention, the present shoe tree is provided with a quick release mechanism for securing the toe member to the heel member so that the toe member and the heel member may be assembled together and inserted into the respective shoe to give support thereto.

BRIEF DESCRIPTION OF THE DRAWING

Further objects of the present invention together with additional features contributing thereto and advantages accruing therefrom will be apparent from the following description of a preferred embodiment of the invention which is shown in the accompanying drawing with like reference numerals indicating like components throughout, wherein.

DETAILED DESCRIPTION OF A PREFERRED EMBODIMENT

Figure 1:
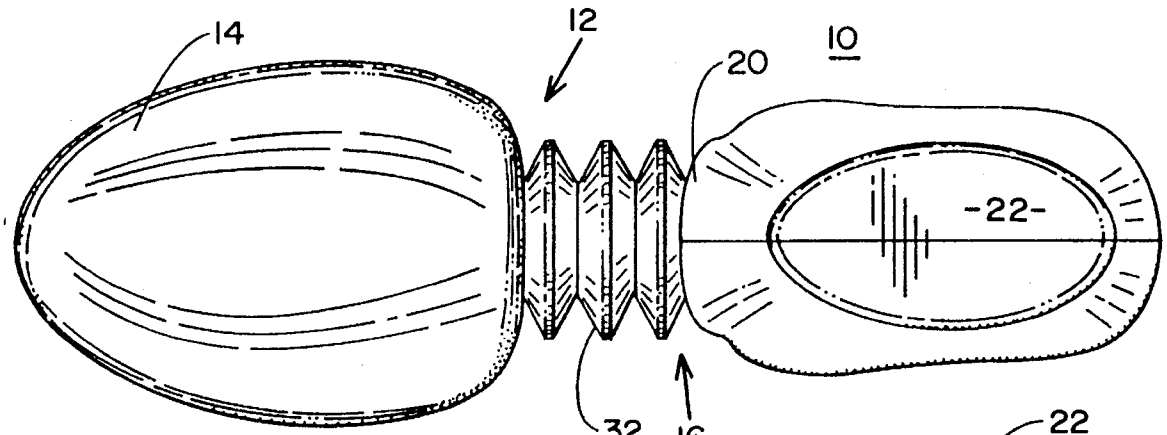
FIG. 1 is a plan view of a two-piece high top shoe tree according to the present invention.
Figure 2:
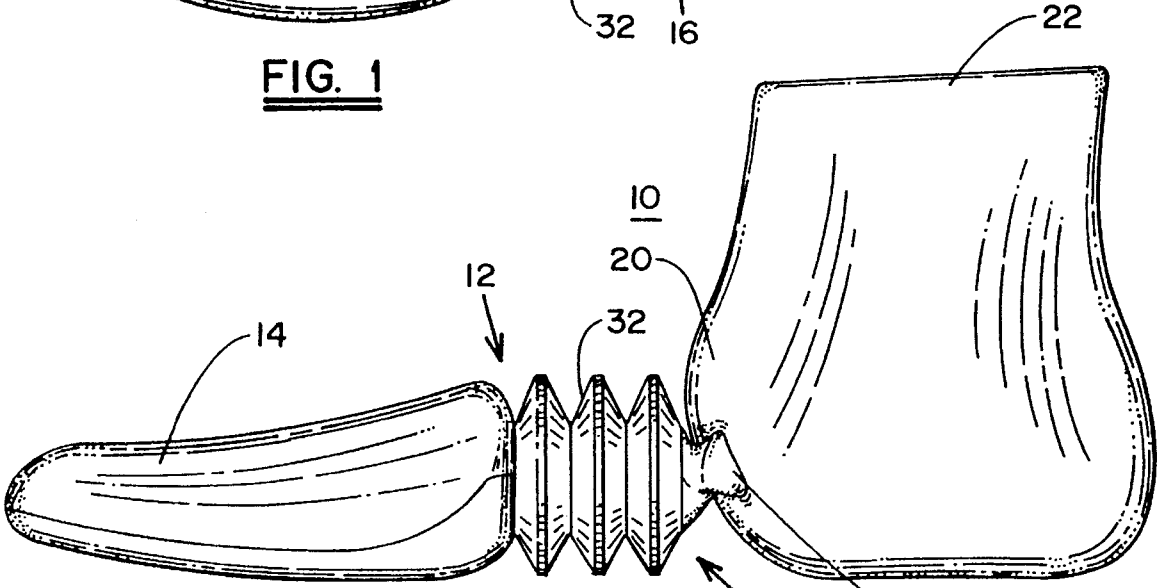
FIG. 2 is a side elevation view of the two-piece high top shoe tree illustrated in FIG. 1.
Figure 3:
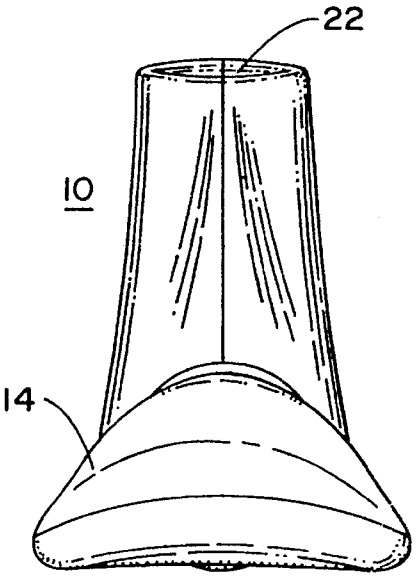
FIG. 3 is a front elevation view of the two-piece high top shoe tree illustrated in FIGS. 1 and 2.

Referring now to the drawing, and initially to FIGS. 1–3, there is shown a high top shoe tree 10 in accordance with the present invention. The high top shoe tree 10 includes a toe member 12 having a distal tip end 14 and a proximal end 16. The high top shoe tree 10 also includes an L-shaped heel member 18 which includes a forward end 20 and a top end 22.

Figures 4, 5:
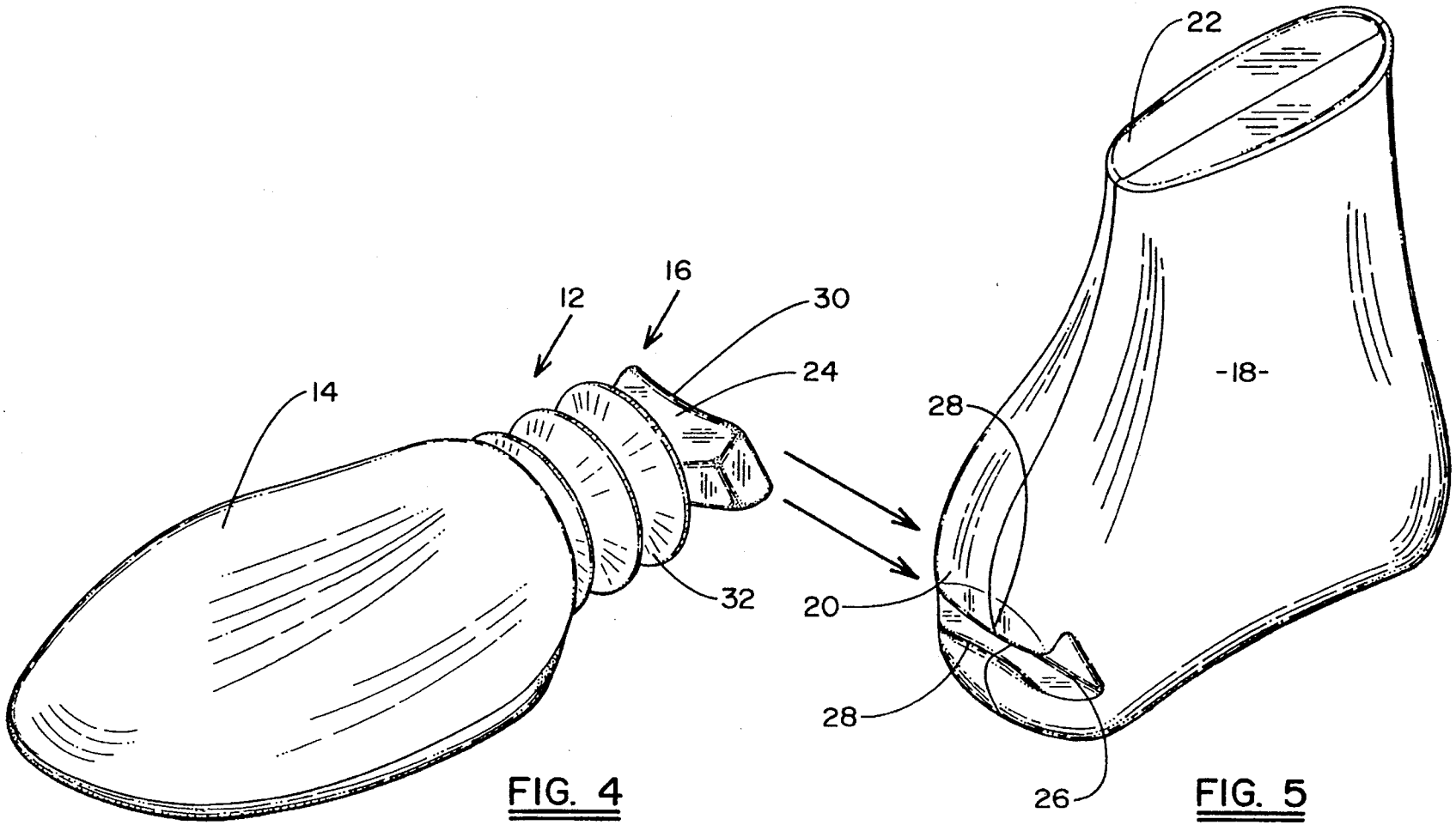
FIG. 4 is a perspective view of the toe member of the present two-piece high top shoe tree.
FIG. 5 is a perspective view of the heel member of the present two-piece high top shoe tree, FIGS. 4 and 5 showing the detachable feature of the present invention.

With reference now to FIGS. 4 and 5, it is shown that the toe member 12 and heel member 18 include a quick release mechanism that is formed by a dovetail tenon 24 formed in the proximal end 16 of the toe portion and a mortise slot 26 formed in the forward end 20 of the heel member 18. The mortise slot 26 is shaped to correspond to the dovetail tenon 24. As illustrated in FIG. 5, the mortise slot 26 is slightly narrower in the center than it is on the ends of the slot 26. In this manner, the mortise slot 26 includes opposing convex members 28-28. The dovetail tenon 24 is provided with corresponding concave members 30 formed in the top and bottom longitudinal edges thereof. In this manner, when the dovetail tenon 24 is slid into the mortise slot 26, the convex and concave members 28 and 30 engage each other to seat the dovetail tenon 24 within the mortise slot 26 such that the mortise slot 26 completely contains the dovetail tenon 24. As shown in FIGS. 1–5, the toe member 12 includes a flexible mid-section 32 formed between the distal tip 14 and the dovetail tenon 24 of the toe member 12. The flexible mid-section 32 in the present embodiment is in the form of a circular bellows member as best shown in FIGS. 1, 3, and 4.

The toe member 12, including the dovetail tenon 24 and flexible mid-section 32, is preferably molded from a flexible plastic material. The distal end tip 14 and the mid-section 32 are preferably hollow. In a similar manner, the heel member 18 is formed of the same flexible plastic material in an injection process well known in the art and is also hollow. The shoe tree 10 is thus lightweight so that added weight to the shoe is minimized. Given the flexibility of the=mid-section 22 as provided by virtue of the compression rings 33 and resilient plastic material, when the toe member 12 is engaged with the heel member 18, as shown in FIG. 2, the distal tip end 14 of the toe member 12 is movable, relative to the heel member 18. The mid-section 32 is formed by a series of compression rings 33 that allow the heel member 18 to be compressed against the toe member 12 to facilitate insertion of the shoe tree 10 into a respective shoe.

Figure 6:
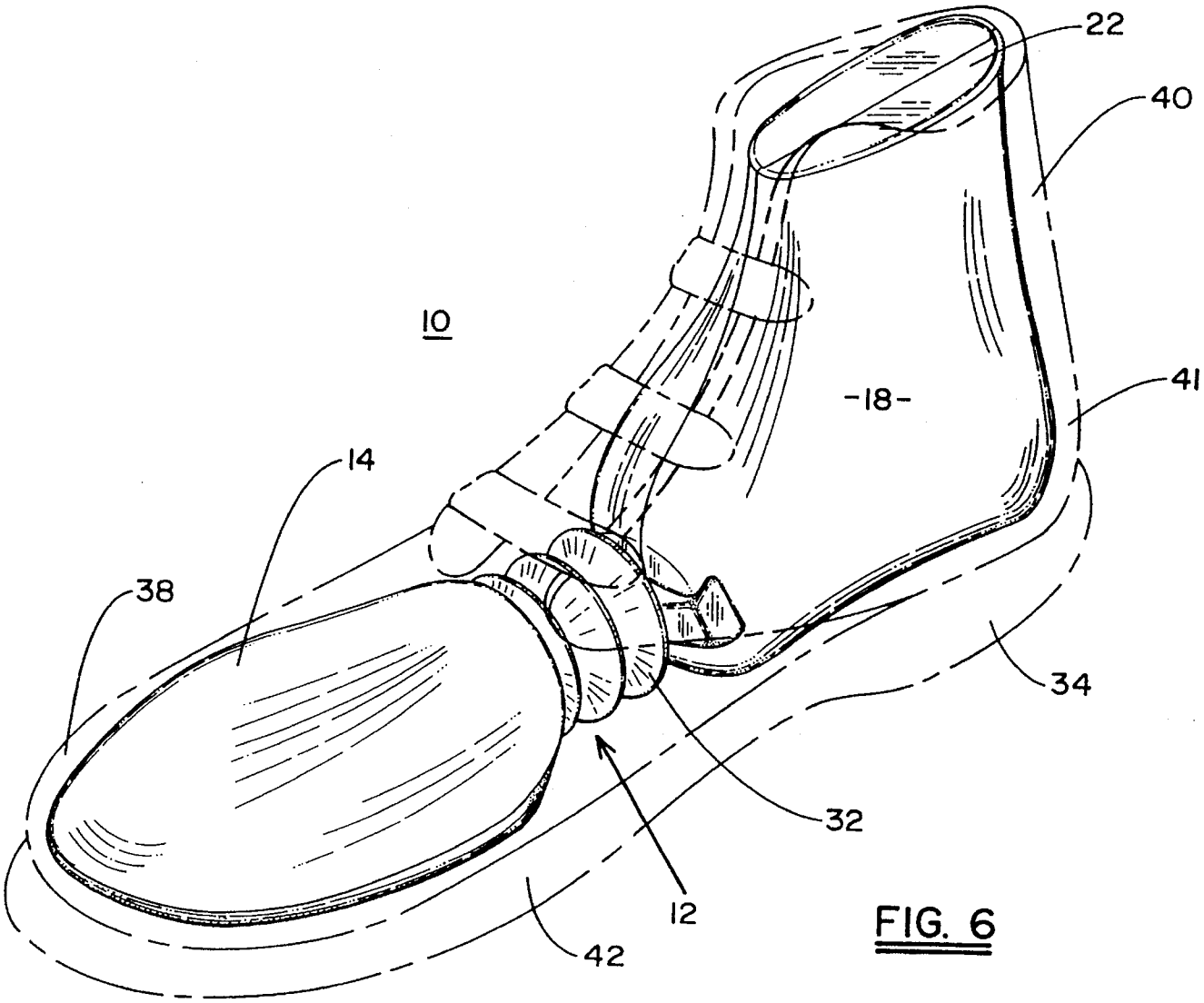
FIG. 6 is a perspective view of the present two-piece high top shoe tree illustrated in conjunction with a high top shoe shown in phantom.
Figure 7:
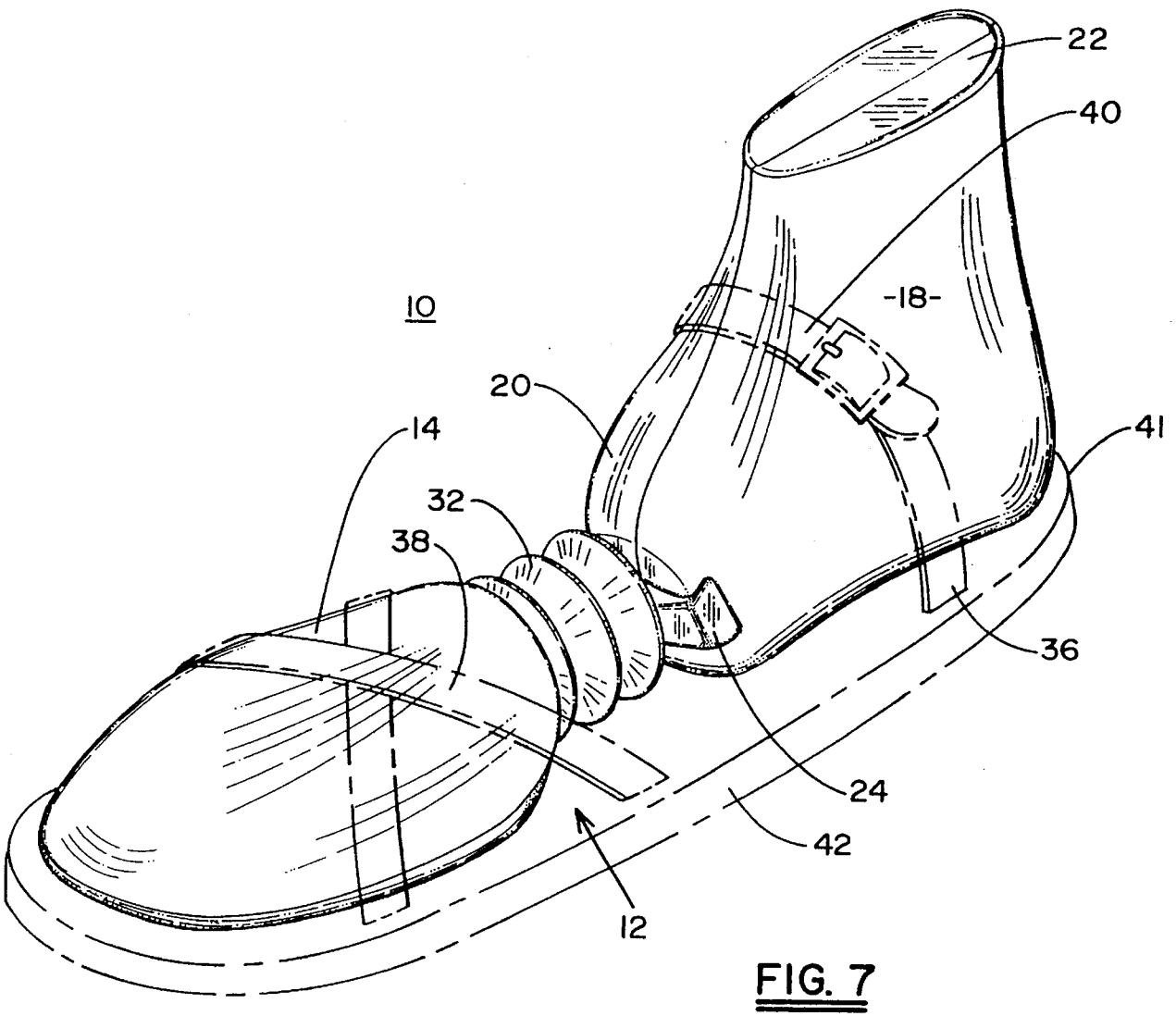
FIG. 7 is a perspective view of the present two-piece high top shoe tree illustrated in conjunction with a sandal shown in phantom.

Referring now to FIGS. 6 and 7, it is shown that the present high top shoe tree 10 can be used in conjunction with a high top shoe 34 shown in phantom in FIG. 6 or a sandal 36, as illustrated in FIG. 7. Both the high top shoe 34 and sandal 36 include a toe portion 38 and a heel portion 40. The illustrative shoe 34 and sandal 36 each include a front tip 39, a back 40, and a midpoint 42. Thus, FIGS. 6 and 7 illustrate the manner in which the present two-piece high top shoe tree 10 may be used in order to support the toe portion 38 and heel portion 40 of a high top shoe 34 or a sandal 36. The toe member 12 of the shoe tree 10 may be used separately to support the toe Portion 38 of a sandal or shoe. In addition, the heel member 18 may be disconnected from the toe member 12 and used separately for supporting the heel portion 40 of a shoe or a sandal.

There has thus been disclosed a novel and easily fabricated two-piece high top shoe tree 10 which may be used in conjunction with high top shoes or sandals for both preserving the shape of the footwear while it is stored, as well as providing an attractive and eyecatching shape forming element for use during display of the footwear.

While this invention has been described in detail with reference to a certain preferred embodiment shown in conjunction with different types of footwear, it should be appreciated that the present invention is not limited to that precise embodiment. For example, the L-shape of the heel member 18 may be reduced to a block configuration or conversely, may be extended vertically, horizontally, or both. Vertical extension of the heel member would provide the display effect of combining a shoe tree with the leg of a mannequin. In addition, different types of quick release mechanisms are contemplated as being within the scope of the present disclosure. This includes a variety of possible detent means for seating and aligning the toe member with the heel member. Therefore, in view of the present disclosure which describes the current best mode for practicing the invention, many modifications and variations would present themselves to those of skill in the art without departing :from the scope and spirit of this invention, as defined in the following claims.

What is claimed is:

1. A high top shoe tree for use with foot wear, said shoe tree comprising:

a toe member, having approximately the shape of the front half of a human foot, having a distal tip end and a proximal end, said toe member being insertable into a toe portion of a respective piece of footwear and formed to support the toe portion of the footwear;

an L-shaped heel member having approximately the shape of the back half of a human foot, being insertable into a heel portion of the respective piece of footwear and formed to support the heel portion thereof, said heel member having a forward end and a top end and extending from said midpoint of the footwear to a back thereof when inserted therein;

quick release means for securing said toe member to said heel member whereby said toe member and said heel member may be assembled together and inserted into the respective piece of footwear to give support thereto said quick release means including a dovetail tenon formed on said proximal end of said toe member; and a mortise slot formed in said forward end of said heel member, said mortise slot being shaped to correspond to said dovetail tenon so that it is snugly slidable into said mortise slot whereby said toe member is secured to said heel member at a midpoint of the respective piece of footwear when the two members are inserted therein.

2. The high top shoe tree according to claim 1 wherein said toe member is formed in the shape of a front half of a foot to occupy all the space in the toe portion of said respective piece of footwear, and said quick release means allows said toe member to be easily detached from said heel member so that said toe member may be separately employed to support the toe portion of the respective piece of footwear.

3. The high top shoe tree according to claim 1 wherein said heel member is formed in the shape of a back half of a foot up to ankle height to fully occupy the space in the heel portion of said respective piece of footwear, and said quick release means allows said heel member to be easily detached from said toe member so that said heel member may be separately employed to support the heel portion of the respective piece of footwear.

4. The high top shoe tree according to claim 1 further including detent means for seating said dovetail tenon within said mortise slot.

5. The high top shoe tree according to claim 4 wherein said toe member including said dovetail tenon is formed from a flexible molded plastic material.

6. The high top shoe tree according to claim 5 wherein said toe member further includes a flexible midsection formed between said distal tip end and said dovetail tenon, said mid-section allowing said distal tip end to move relative to said dovetail tenon.

7. The high top shoe tree according to claim 4 wherein said heel member including said mortise slot is formed from a flexible molded plastic material.

8. The high top shoe tree according to claim 4 wherein said detent means includes at least one outwardly directed convex member and a corresponding inwardly directed concave member, said convex and concave members being each formed alteratively on said dovetail tenon and said mortise slot so that when said dovetail tenon is slid into said mortise slot, said convex and concave members engage each other to seat the dovetail tenon within said mortise slot.

9. A two-piece shoe tree for use with footwear, said shoe tree comprising:

a toe member, having approximately the shape of the front half of a human foot, having a distal tip end and a proximal end, said toe member being insertable into a toe portion of a respective piece of footwear and formed to support the toe portion of the footwear;

a heel member having approximately the shape of the back half of a human foot, being insertable into a heel portion of the respective piece of footwear and formed to support the heel portion thereof, said heel member having a forward end and a top end extending to ankle height, said heel member extending from said midpoint of the footwear to a back thereof when inserted therein;

quick release means for securing said toe member to said heel member whereby said toe member and said heel member may be assembled together and inserted into the respective shoe to give support thereto said quick release means including a dovetail tenon formed on said proximal end of said toe member; and a mortise slot formed in said formed end of said heel member, said mortise slot being shaped to correspond to said dovetail tenon so that it is snugly slidable into said mortise slot whereby said toe member is secured to said heel member at a midpoint of the respective piece of footwear when the two members are inserted therein.

10. The two-piece shoe tree according to claim 9 wherein said toe member is formed in the shape of a front half of a human foot to fully occupy void space in the toe portion of said respective piece of footwear, and said quick release means allows said toe member to be easily detached from said heel member so that said toe member may be separately employed to support the toe portion of the respective piece of footwear.

11. The two-piece shoe tree according to claim 9 wherein said heel member is formed in the shape of a back half of a human foot up to ankle height to fully occupy the space in the heel portion of said respective piece of footwear, and said quick release means allows said heel member to be easily detached from said toe member so that said heel member may be separately employed to support the heel portion of the respective piece of footwear.

12. The two-piece shoe tree according to claim 9 further including detent means for seating said dovetail tenon within said mortise slot.

13. The two-piece shoe tree according to claim 12 wherein said toe member including said dovetail tenon is formed from a flexible molded plastic material.

14. The two-piece shoe tree according to claim 13 wherein said toe member further includes a flexible mid-section formed between said distal tip end and said dovetail tenon, said mid-section allowing said distal tip end to move relative to said dovetail tenon.

15. The two-piece shoe tree according to claim 12 wherein said heel member including said mortise slot is formed from a flexible molded plastic material.

16. The two-piece shoe tree according to claim 12 wherein said detent means includes at least one outwardly directed convex member and a corresponding inwardly directed concave member, said convex and concave members being each formed alternatively on said dovetail tenon and said mortise slot so that when said dovetail tenon is slid into said mortise slot, said convex and concave members engage each other to seat the dovetail tenon within said mortise slot.

* * * * *